United States Patent [19]

Russ

[11] Patent Number: 4,489,851

[45] Date of Patent: Dec. 25, 1984

[54] CONTAINER COVER LOCK

[76] Inventor: Norman Russ, Box 508, Norwich, Conn. 06360

[21] Appl. No.: 503,669

[22] Filed: Jun. 13, 1983

[51] Int. Cl.[3] ..... B65D 45/28

[52] U.S. Cl. ..... 220/323; 220/246

[58] Field of Search ..... 220/323, 324, 243, 244, 220/318, 246

[56] References Cited

U.S. PATENT DOCUMENTS

| | | | |
|---|---|---|---|
| 1,015,907 | 1/1912 | Ryder | 220/246 |
| 1,581,060 | 4/1926 | Hug | 220/323 X |
| 4,384,656 | 5/1983 | McQuiston et al. | 220/323 |

*Primary Examiner*—Steven M. Pollard

*Attorney, Agent, or Firm*—Paulding & Huber McCormick

[57] ABSTRACT

A manually-operated device assembled to the underside of the cover or lid which usually accompanies the purchase of a common household refuse or "garbage" can, said device consisting of a group of spring-loaded rods or bars whose ends are so formed as to fit into the circumferential recess or beads which are part of said can and provide stiffening at the top of the can, said rods or bars being moved into a locked position within the can's recess by depressing an external handle to which is fastened tapered rods projecting inside the cover, said tapered rods contacting a certain portion of the lock rods, and also by pulling up the handle said rods will allow the lock rods to retract from the can's recess and permit removal of the cover.

1 Claim, 4 Drawing Figures

CONTAINER COVER LOCK

BACKGROUND OF THE INVENTION (a) Technical Field

This invention relates generally to various means of providing lockable covers for household or industrial refuse containers. The common refuse can is usually supplied with a friction-fit cover that is easily manipulated, but not very secure if the can is upset by a person or marauding animal, the latter case being quite prevalent.

(b) Background Art

As previously described in part (a), the friction-fit cover does not offer maximum security. There are presently, heavy and costly plastic containers with external locking devices which sometimes require unusual effort to operate. The present invention allows use of the relatively inexpensive metal can which is commonly made with one or more stiffening beads about its upper periphery, this feature lending itself to the locking arrangement to be further detailed.

SUMMARY

It is the object of this improvement to show a preferred form of locking the cover of a refuse can in a simple and secure manner. Reference is hereby made to the accompanying drawings.

DESCRIPTION OF THE PREFERRED EMBODIMENTS

Figure 1:
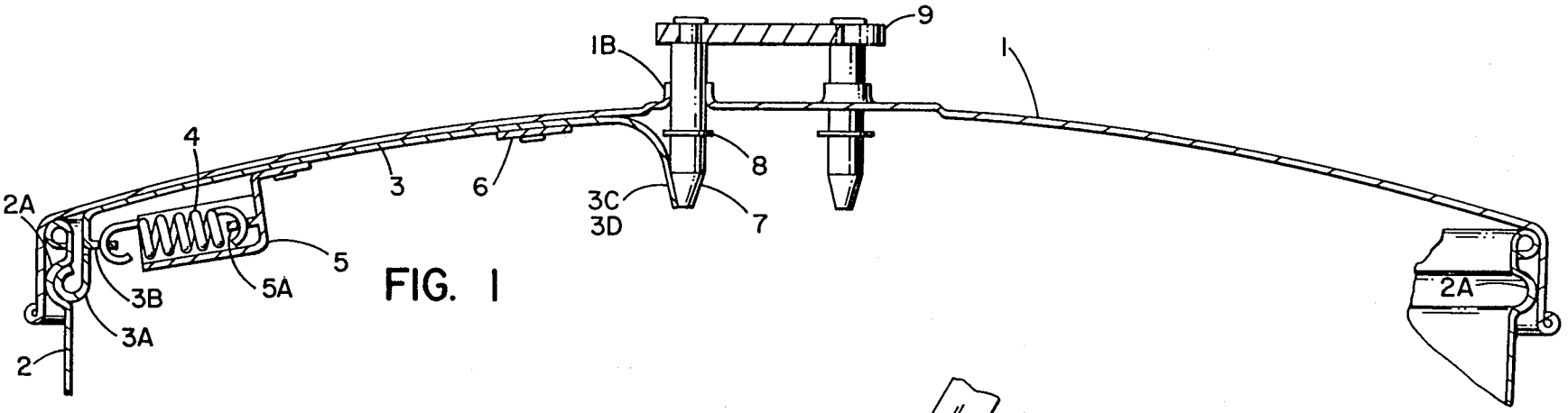
FIG. 1 An elevation cross-section through the center of a typical metal refuse can showing a locking rod or bar and the operating handle in the secured position.
Figure 2:
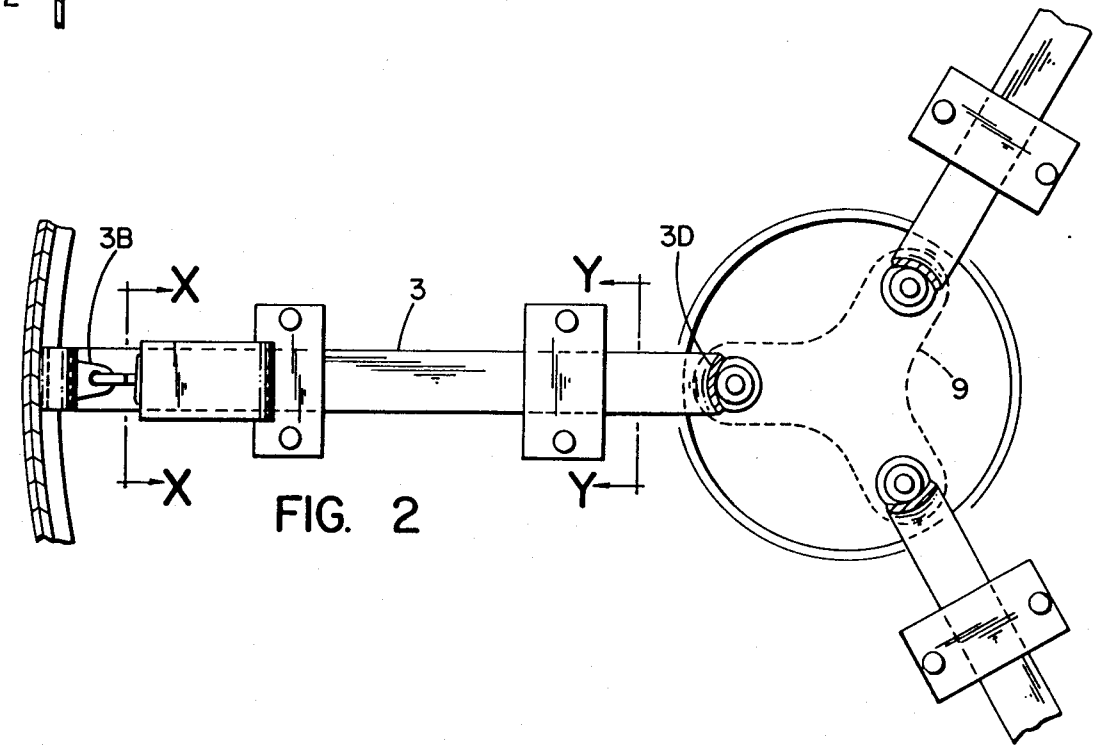
FIG. 2. A plan view reflecting the underside of the cover showing fully one of the locking rods, its retention and guidance, portions of the other rods, and the externally located operating handle which is outlined by the dashed lines.

In the form of the invention shown in the accompanying drawings, FIGS. 1 & 2, a typical metal can cover 1 is in place on a typical metal can 2, the can's circumferential stiffening bead noted by 2A. Assembled to the underside of cover 1 are three (3) locking rods or bars 3, one end of which at 3A is so formed as to nest with the stiffening bead 2A. Near the center of the cover the rod curves downward and is also concave as shown by 3C & 3D. This dual shape offers the large radius which serves as a ramp-type surface to be actuated by tapered rod 7 when handle 9 is depressed. Concave surface 3D aids in stiffening large radius 3C and acts to stabilize rod 7 during its motion. Attached to rod 7 is ring 8 which limits the upper travel of rod 7 and prevents removal of handle 9.

Locking rods 3 of rigidly shaped metal are guided in outwardly formed channels 1A in cover 1, said rods and channels conforming to the contour of cover 1 and contributing to maximum space and minimizing jamming of the mechanoism by the refuse material in the can.

The combination rod and spring retainer 5 is so formed as to provide a sheath for extension spring 4, said sheath confining spring 4 in the event of breakage or detachment and preventing possible injury to the user. Within retainer 5 is a self-formed tab 5A to hold the loop of spring 4. The lock rod 3 has a similar tab 3B which holds the other loop of spring 4. At the center of cover 1 is also shown rod retainer 6. In operation, the lock rods 3 are held to an inward or releasing motion by spring 4, this arrangement affording a low effort to release lock rods 3 when lifting handle 9 with its attached tapered rods 7. To further increase the stabilization of rods 7, an extruded eyelet 1B is formed in the cover 1 itself. To secure the cover it is only necessary to depress handle 9 whose tapered rods 7 will impart a forward thrust to the large radius 3C of lock rod 3, said motion forcing lock rod end 3A into the can 2 recess 2A.

Figure 3:
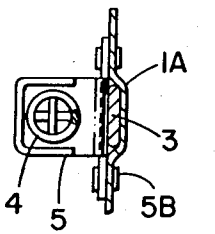
FIG. 3. A partial section on line X—X showing a locking rod and its retainer with provision for holding an extension spring.

Referring to FIG. 3: A partial section on line X—X (taken at FIG. 2) is seen the combination retainer and spring holder 5, a view of spring 4 attached, and rivets 5B with which retainer 5 is fastened to cover 1, and a section through lock rod 3 as it nests within cover channel 1A.

Figure 4:
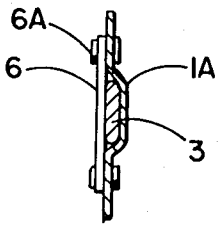
FIG. 4. A partial section on line Y—Y showing the locking rod with the rear retainer strip and its attaching rivets.

Referring to FIG. 4: A partial section on line Y—Y (taken at FIG. 2) showing lock rod 3 in cover channel 1A with rod retainer 6 and its attaching rivets 6A. While the preferred embodiments of this invention have been described in detail herein with accompanying drawings, it is to be understood that this improvement is not limited to the precise arrangement shown. For example, if greater locking security is required, a larger number of lock rods or bars may be employed. In another version, the direction of the spring force may be reversed so as to keep the locking rods engaged in the can recess, thus giving the cover the feature of self-locking by simply placing the cover on the can an pushing down. This arrangement will require a different handle assembly and a slightly greater effort to release, but provides more effective security. Still another device would utilize a rotatable handle with cables to actuate the lock rods. The variations thus described do not depart from the scope or intent of this invention.

I claim:

1. A can and cover assembly comprising a can structure with cylindrical side walls, said can structure side walls having an annular upper rim portion defining an inwardly facing annular groove spaced below said rim portion, a cover structure having an annular skirt adapted to fit outside said annular rim portion and said groove defining portion of said can structure, a manually movable handle mounted centrally of said cover and adapted for limited longitudinal movement in the axial direction between locked and unlocked positions, at least three bars mounted to the underside of said cover for limited radial movement between locked and unlocked positions, outer ends of said bars receivable in said annular groove in the locked positions therefor, springs biasing said bars toward their unlocked positions such that said outer ends are not in said annular groove, inner ends of said bars defining ramp surfaces, and posts engageable with said handle, said posts having inner ends engageable with said ramp surfaces on the inner ends of said bars to cause movement of the bars radially outwardly as the handle is pushed axially inwardly so that said bar outer ends are received in said annular groove to lock the cover in place in response to such inward axial movement of said handle.

* * * * *